US006087933A

United States Patent [19]

Addy et al.

[11] Patent Number: 6,087,933

[45] Date of Patent: Jul. 11, 2000

[54] ANTENNA SWITCHING FOR AMPLITUDE DEGRADATION DURING SUPERVISION AND INSTALLATION OF WIRELESS SECURITY SYSTEMS

[75] Inventors: Kenneth L. Addy; Karl Linford, both of Massapequa, N.Y.

[73] Assignee: Pittway Corporation, Chicago, Ill.

[21] Appl. No.: 09/179,115

[22] Filed: Oct. 26, 1998

Related U.S. Application Data

[63] Continuation-in-part of application No. 08/650,292, May 20, 1996, Pat. No. 5,828,300, which is a continuation-in-part of application No. 09/063,753, Apr. 21, 1998.

[51] Int. Cl.[7] ..... G08B 1/08

[52] U.S. Cl. ..... 340/539; 340/506; 340/514

[58] Field of Search ..... 340/539, 506, 340/514, 825.06; 364/138, 140, 141

[56] References Cited

U.S. PATENT DOCUMENTS

| | | | |
|---|---|---|---|
| 4,656,364 | 4/1987 | Yokogawa | 307/112 |
| 5,465,411 | 11/1995 | Koike | 455/275 |
| 5,648,992 | 7/1997 | Wright et al. | 375/347 |
| 5,661,762 | 8/1997 | Petranovich | 375/347 |
| 5,699,054 | 12/1997 | Duckworth | 340/825.22 |
| 5,761,613 | 6/1998 | Saunders et al. | 455/273 |

*Primary Examiner*—Donnie L. Crosland
*Attorney, Agent, or Firm*—Greenberg Traurig; Anthony R. Barkume

[57] ABSTRACT

A method for testing the signal margin of an alarm system during installation of the alarm system and during the alarm system supervision time. The alarm system comprises a plurality of remote transmitting devices and a receiver/control unit. The receiver/control unit comprises a receiver with at least one antenna apparatus and processing apparatus for processing messages received from each of the remote devices. Both the install mode and the supervision mode cause the receiver/control unit to receive signals at a lower level than normal by selecting an associated antenna configuration. When entering the installation mode, the processor switches the antenna apparatus to a "no antenna" state, and when entering the supervision mode, the processor switches two or more antenna apparatus to an "on" state.

21 Claims, 6 Drawing Sheets

ANTENNA SWITCHING FOR AMPLITUDE DEGRADATION DURING SUPERVISION AND INSTALLATION OF WIRELESS SECURITY SYSTEMS

CROSS REFERENCE TO RELATED APPLICATION

This application is a continuation-in-part of U.S. application Ser. No. 08/650,292, filed on May 20, 1996, now U.S. Pat. No. 5,828,300 which is incorporated by reference herein. This application is also a continuation-in-part of co-pending U.S. application Ser. No. 09/063,753, filed on Apr. 21, 1998, which is incorporated by reference herein.

BACKGROUND OF THE INVENTION

The present invention relates to alarm systems having multiple remote devices in communications with a receiver/control unit wherein the receiver/control unit comprises one or more antennas; and in particular to such alarm systems wherein the receiver sensitivity is modified during the installation of a remote device and during the reception of a supervision signal from a remote device, in order to ensure there is adequate margin between the remote device and the receiver/control unit during normal alarm signal transmission operations.

Contemporary radio frequency (RF) wireless security systems, such as those utilizing the ADEMCO 4281 or 5881 receiver, often use receiver antenna diversity, whereby signals from different locations are equally detected. The information transmitted from remote devices typically describes the state of various sensors, such as smoke, motion, breaking glass, shock and vibration detectors; door, window and floor mat switches; etc. These remote device sensor products are designed to be low in cost and are typically send-only devices, as opposed to send/receive, or transceiver, devices which are significantly more expensive.

As taught in U.S. Pat. No. 4,754,261 to Marino, during alarm system installation, transmission of signals from the remote devices to the receiver/control unit at a reduced sensitivity allows the installer to check the transmission signal margin of the remote devices. If the receiver/control unit recognizes a message from each remote device at a reduced sensitivity of the order of approximately 12 dB, then there will be adequate signal margin during normal operation. That is, if the radio environment changes during normal operation, due to movement of furniture etc., the alarm signal transmissions have sufficient signal strength to be received by the receiver/control unit in this changed, adverse condition.

In addition, in order to meet basic regulatory agency requirements, the remote devices are required to transmit periodic supervision transmission signals in order for the receiver/control unit to monitor proper operation of all of the remote devices in a given system. The supervision signal (as well as an alarm signal) has a unique identification code embedded in its data message, which serves to identify to the receiver/control unit which particular transmitting remote device has sent that supervision (or alarm) message. For life safety applications, the RF wireless system must also comply with more stringent regulations, such as the Underwriters Laboratories regulation UL864. This regulation additionally requires that the supervision signal be reduced in transmission power level below that of the alarm (normal, non-supervision) signal transmission by a minimum of approximately 3 dB or by other equivalent means, to ensure that the alarm signal has an effective power margin over that of the periodic supervision signals from each remote transmitter device in the system.

Employing transmitter-only products that would accurately transmit an alarm signal at the maximum allowable level and then reducing that power level during the periodic supervision signal transmission or during alarm system installation, would add significant additional cost to each transmitter product. Therefore, the sensitivity reduction desired in installation as well as supervision may be achieved at a point in the receiver which is "post detection" by means of a simple thresholding scheme as set forth in co-pending U.S. application Ser. No. 08/650,292. Such a thresholding scheme is often very cost effective, but may lead to pulse distortion which may have unforeseen side effects in the decoding process. It would be advantageous to introduce a reduction in sensitivity at a "pre-detection" point at the receiver, where the reduction in sensitivity truly effects the system signal-to-noise ratio.

It is therefore an object of the present invention to provide a method for ensuring that an adequate signal margin exists between the receiver/control unit and the remote devices during alarm system installation.

It is a further object of the present invention to provide an alarm system with a supervision mode, wherein a reduced power signal is effectively generated and processed without the remote device being altered.

It is a further object of the present invention to provide a method of impairing the receiver sensitivity during alarm system installation and during a supervision transmission sequence.

It is a further object of the present invention to provide a method of reducing the receiver sensitivity at a "pre-detection" point within the receiver.

SUMMARY OF THE INVENTION

In accordance with these and other objects, the present invention is a method for testing the signal margin of an alarm system. The alarm system has two modes where the signal margin is tested; the first mode is during the alarm system installation, and the second mode is during the periodic supervision time of the alarm system.

The alarm system comprises a receiver/control unit adapted to operate in an install mode, the receiver/control unit comprising at least one antenna means for receiving signals from a remote transmitter device, processing means operatively associated with the receiver wherein the install mode causes the impairing of the ability of the receiver/control unit to receive messages by changing a characteristic of the antenna means, a plurality of remote devices, each of the remote devices having a transmitter for transmitting a message, the remote device being relocatable during installation with respect to the receiver/control unit, and means for indicating when the impaired message is successfully received.

The installation method comprises the steps of initiating an install mode in the receiver/control unit, impairing an operational parameter of the receiver by changing a characteristic of the antenna means, transmitting a message from a remote device, the remote device being relocatable with respect to the receiver/control unit during its installation, receiving the message at the changed receiver/controller, and indicating when the message is successfully received.

When entering the installation mode, a processor in the receiver/control unit initiates a change of a characteristic of the antenna means by switching the antenna means to a "no antenna" state, and the receiver receives a signal at a level that is approximately 12 dB lower than the signal received during normal operation. The switching of the antenna means is preferably accomplished by processor control of switching diodes. In addition, capacitors may be used for better control of the residual capacitance of the switching diodes in their off state, thereby controlling the conduction of the RF input signal. The alarm system may further comprise a digital-to-analog converter for additional control of the conduction of the RF input signal.

In addition, when the message is not successfully received after changing the characteristic of the antenna means, the installer then relocates the remote device in an attempt to obtain a better signal margin with the receiver/control unit. The remote device transmits a new message, and when the receiver successfully receives the new message, the control unit indicates that the new message has been successfully received. The installer subsequently initiates a normal operation mode (i.e. return the characteristic of the antenna means to normal) in the receiver/control unit when the message has been successfully received.

The second testing mode occurs during the supervision of the system in normal operation (after installation is complete), and comprises the steps of receiving at the receiver/control unit a message from a remote transmitting device, wherein the remote transmitting devices are capable of transmitting a supervision signal having a plurality of correlated supervision messages and alarm signals having a plurality of correlated alarm messages indicative of an alarm status, determining if the message is a supervision message or a non-supervision message, and impairing the ability of the receiver/control unit to receive subsequent messages by changing a characteristic of the antenna means when the message is determined to be a supervision message. Impairment of the receiver/control unit is preferably accomplished by the selection of two or more antenna means to an "on" state. The message is then received at a power level that is approximately 3 dB lower than the normal operating power level. The method further comprises the steps of receiving a subsequent message, determining if the subsequent message is correlated to the first message, and returning the changed characteristic of the antenna means to normal when the subsequent message is determined to be correlated to the first message.

If, after a predetermined time, no subsequent message has been received which is correlated to the first message, then the changed characteristic of the antenna means of the receiver is returned to normal and the first message is ignored.

DETAILED DESCRIPTION OF THE PREFERRED EMBODIMENT

Figure 1:
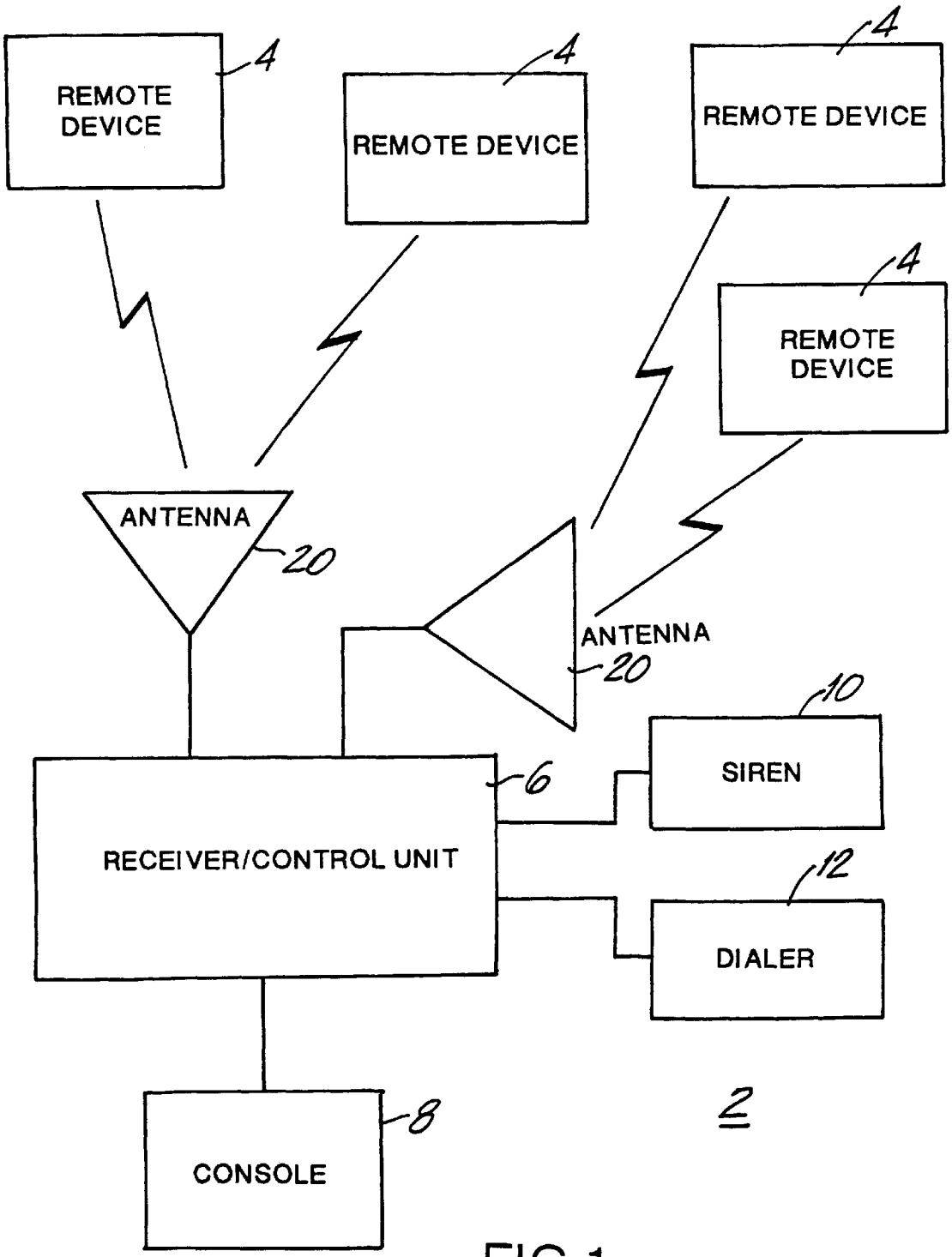
FIG. 1 is a block diagram of the preferred embodiment of the present invention.

Referring to FIG. 1, an alarm system 2 is shown, which includes a receiver/control unit 6 in communications with a plurality of remote devices 4, each of which comprises an alarm sensor and a data transmitting unit. The alarm sensors are well known in the art and include, for example, motion detectors, fire or smoke sensors, glass breakage sensors, door or window entry sensors, and the like. The alarm system 2 operates in a so-called "wireless" fashion by electromagnetic wave transmission (radio frequency in particular) between the remote devices 4 and the antennas 20 of the receiver/control unit 6. The transmitter units housed within each remote device 4 are also well known in the art, and transmit supervision and alarm message signals, to be described below, by modulating a high frequency RF signal (e.g. 345 MHz). In the preferred embodiment, the modulated RF signal is received by two antennas 20, which are mounted in orthogonal relationship to each other to achieve antenna diversity, although this specific type of mounting is not a requirement and is not the basis of the present invention. The receiver/control unit samples each antenna until a proper message preamble (discussed below) or signal level is detected. At this point, the antenna switching is stopped until the message is completely received. The receiver/control unit 6 processes and decodes the data from the remote device 4 and then acts accordingly; e.g. by sounding a siren 10, dialing a police or fire station (dialer 12), etc. In addition, a user or installer can enter commands to the alarm system, such as install mode/normal mode or alarm activation/alarm deactivation, through the console 8. The console 8 also contains a beeper, at least one use of which is during installation to show that an alarm signal has been received by the receiver/control unit from the remote device 4. Further description of this type of wireless alarm system may be found in U.S. Pat. No. 4,754,261 to Marino, which is owned by the assignee of the present invention and is incorporated by reference herein.

There are two modes where the transmission between the remote devices 4 and the receiver/control unit 6 are tested to ensure adequate signal margin. The first mode is during the alarm system 2 installation, whereby the installer causes an alarm message from each remote device 4 to be transmitted to the receiver/control unit 6 while the receiver/control unit 6 is at a reduced sensitivity and checks that the signal is recognized by the receiver/control unit 6. This ensures there is adequate signal margin if the radio environment changes during normal operation. The second mode is during the periodic supervision time of the alarm system 2. The supervision time occurs when the receiver/control unit 6 detects a supervision message from a remote device, which is likely to be the first of a plurality of supervision messages. The receiver/control unit 6 then goes into a reduced sensitivity mode to allow detection of the next supervision message at a reduced sensitivity. The remote devices 4 transmit supervision signals in accordance with a protocol known in the art. The supervision signals provide periodic "test" signals for the purpose of ensuring that each remote device 4 is in proper communication with the receiver/control unit 6.

Figure 2:
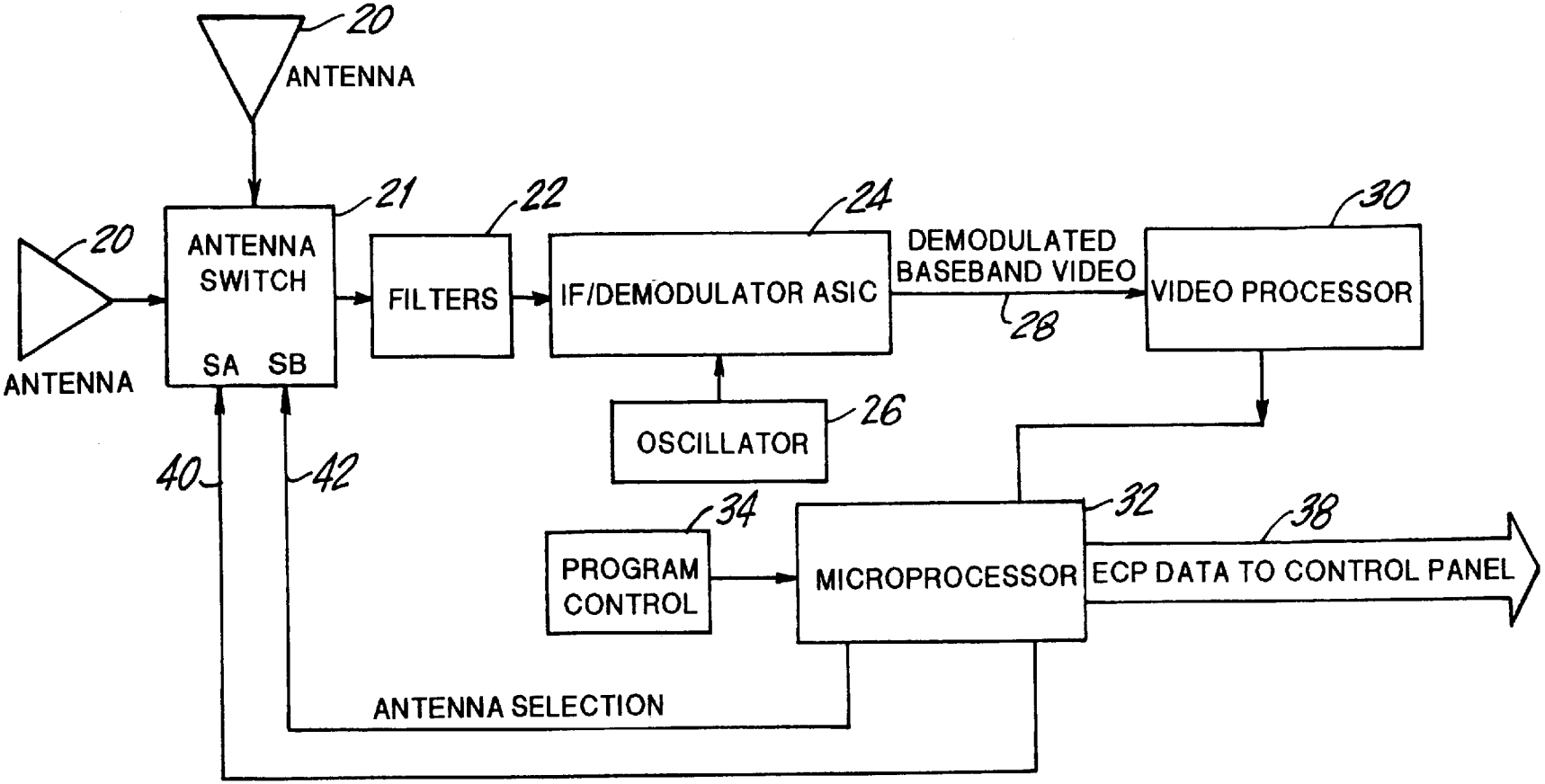
FIG. 2 is a block diagram of the receiver/control unit according to the preferred embodiment of the present invention.

The basis of the present invention is to accomplish the reduction in sensitivity for both of these testing modes by changing the antenna configuration, in particular by impairing the ability of the antenna configuration to properly receive a message. FIG. 2 illustrates the circuit block diagram of the receiver/control unit 6 of the present invention. The antenna configuration is selected by antenna switch 21. The microprocessor 32 outputs antenna control lines 40 and 42, which causes the connection of one of either antenna, neither antenna, or both antennas to filter section 22. As with the prior art, one antenna is used while waiting for and receiving messages; microprocessor 32 outputs control signals 40 and 42 to switch between each antenna until a proper message pre-amble is detected by the microprocessor 32. This type of alternate switching between one antenna or the other for antenna diversity is well known in the art.

In contrast, use of no antenna and/or both antennas in an alarm system 2 to intentionally impair or degrade the reception capability for testing purposes is the subject of this invention. A "no antenna" selection, used during installation of the alarm system 2, causes messages sent by remote devices 4 to be received at a sensitivity level approximately 12 dB below normal sensitivity. Even though no antenna means is connected to the processing electronics, the messages are still received because the PIN diodes which are used for antenna switching are not perfect high impedance sources in their off state. Therefore, when the PIN diode is off, there is some residual capacitance which allows conduction of the RF input signal. Likewise, selection of both antennas, used during supervision time, causes messages sent by remote devices 4 to be received at a sensitivity level approximately 3 dB below normal sensitivity. The connection of both antennas causes a double termination. The incoming radiated energy is the same, but the input impedance is reduced by the double termination, thereby causing the amplitude of the RF signal into the input amplifier and filters to be lower.

Figure 3:
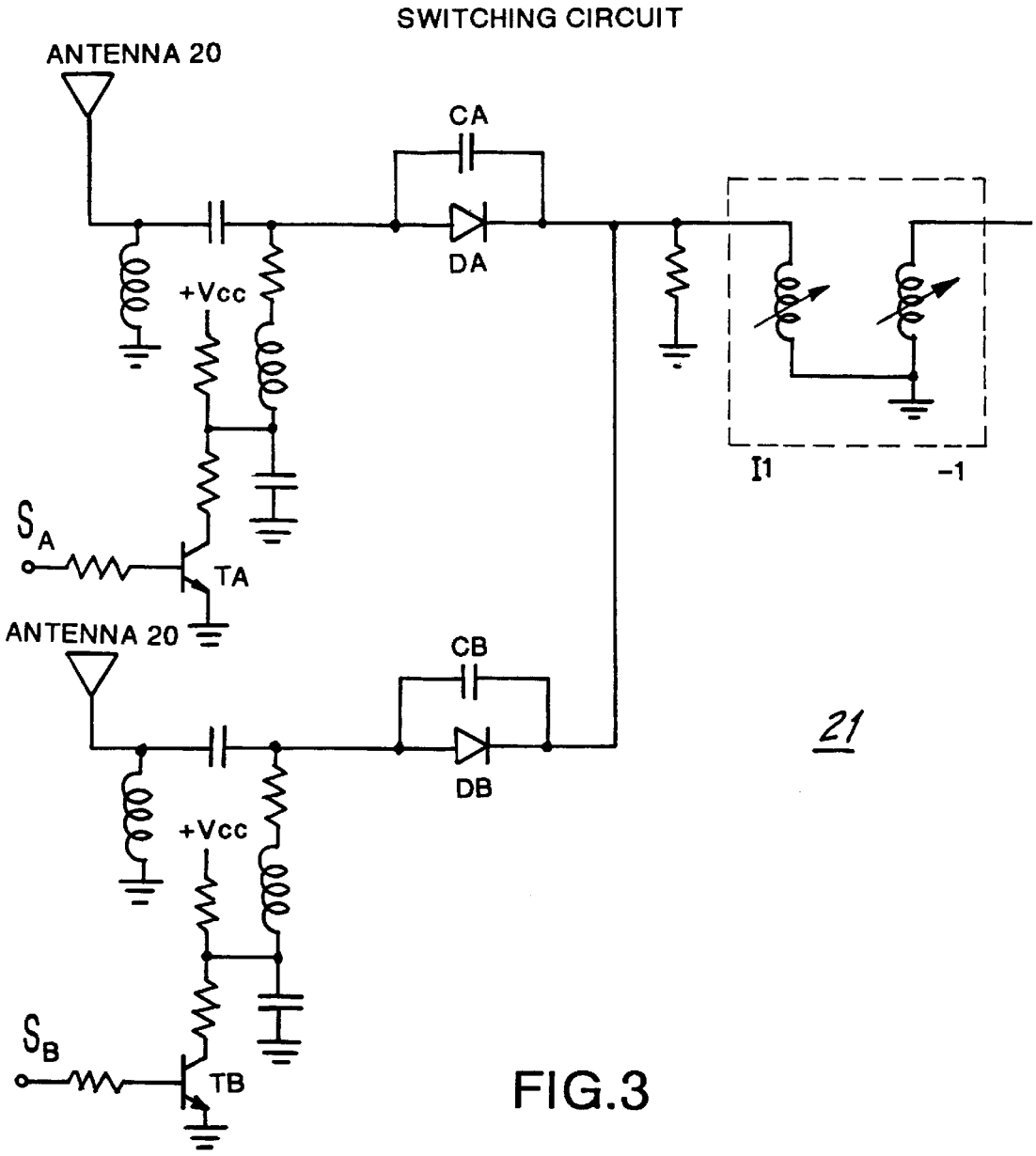
FIG. 3 is a detailed diagram of the antenna switching circuit.
Figure 4:
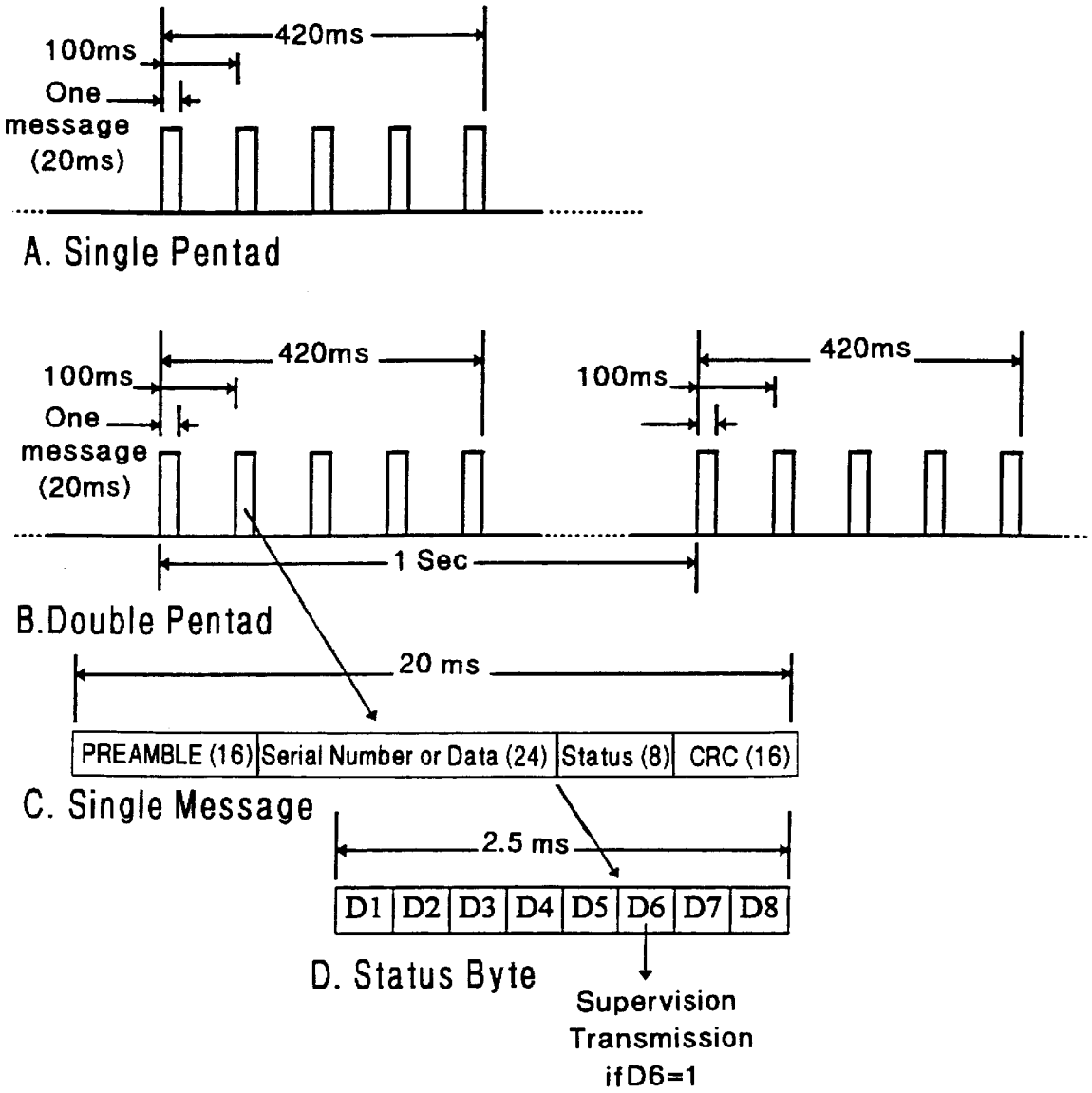
FIG. 4 is a timing diagram of the supervision and alarm messages processed by the preferred embodiment of the present invention.

The resulting RF signal from the antennas is then filtered by filter section 22 and demodulated by section 24 in conjunction with a 355.7 MHz oscillator 26 in accordance with techniques well known in the art. A demodulated baseband video signal 28 is fed to a video processor circuit 30. A microprocessor 32, along with appropriate ROM memory device 34 configured to store the program embodied by the flowchart of FIG. 4, is connected to the antenna switch 21 for supplying appropriate control signals 40 and 42. The control signals input the antenna configuration to the antenna switching circuit 21 shown in detail in FIG. 3.

The antenna switching circuit 21 contains two antennas connected together through PIN diodes DA and DB. The on and off states of the PIN diodes DA and DB are controlled by transistors TA and TB, which in turn are controlled by control signals 40 and 42 from the microprocessor 32. In the on state, the diodes DA and DB allow the energy from their respective antenna to be passed to the filter section through helical filter I1. In the off state, the diodes DA and DB block the energy from their respective antenna from being transmitted. Since the diodes DA and DB are not perfect high impedance sources in their off state, there is some residual capacitance which allows conduction of the RF signal. This capacitance maybe adjusted at the factory or by an installer by adding capacitors CA and CB. The selection of both antennas 20 by the microprocessor 32, causes DA and DB to be turned on. With both antennas on there is a double termination to the input of the filter section 22 and the sensitivity is reduced by approximately 3 dB. Other elements of the antenna switching circuits are basic components known in the art and are not described further.

An alternative more elaborate embodiment would be to control the actual current through the diodes, thereby the attenuation, with a digital to analog converter instead of simply switching the diodes DA and DB to an off state, by means of digital control signals.

The two modes where the transmission between the remote devices 4 and the receiver/control unit 6 are tested are described now. In the alarm system 2 of the preferred embodiment, the "no antenna" state, used during installation, causes the receiver to receive signals at a signal level which is approximately 12 dB lower than normal, while the "both antenna" state, used during supervision, causes the receiver to receive signals at a signal level which is approximately 3 dB lower than normal. It may be desirable to use these or other antenna configurations as alternative embodiments to the above, depending upon the desired amount of reduction in signal strength.

During the installation of the alarm system, the installer enters the install mode via the console 8. The install command is transmitted to the receiver/control unit 6 and the receiver sensitivity is decreased by switching both antennas to their off state. This causes the receiver/control unit 6 to receive signals at a power level of approximately 12 dB lower than its normal level. The installer then installs the remote device 4 and checks the system operation by raising an alarm at the remote device 4, such as by opening a window, and checks that the console beeper has been activated. If the installer hears the beeper from the console, then he knows that there is adequate signal margin. If no beep is heard, then the installer relocates the remote device (such that the path from the remote device to the receiver/control unit will provide better transmission characteristics) until the beep is heard. The installer then completes the installation of the remote device at that location and exits the install mode via the console 8, causing the receiver/control unit 6 to receive at normal power. Thus all messages are conveyed during normal operation at a signal margin above that which was used during installation.

Figure 6:
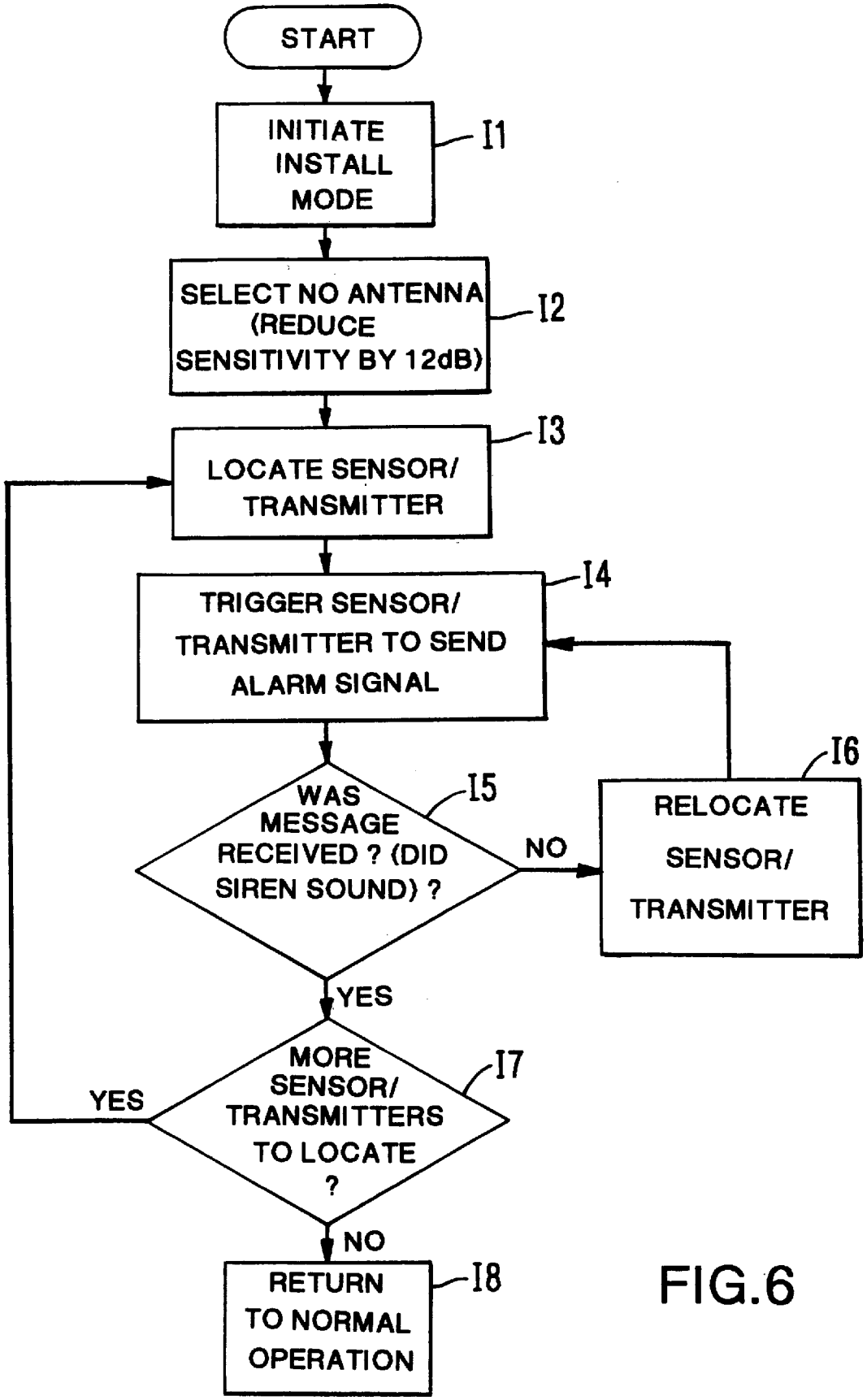
FIG. 6 is a flowchart of the operation of the preferred embodiment of the present invention for installation mode.

This flow of operation for the installation mode of the present invention is illustrated by the flowchart set forth in FIG. 6. The install mode is initiated by the installer, by keying in the install command to the console, shown in step I1. This causes the receiver/control unit to switch the antenna selection to no antenna state, causing the receiver sensitivity to decrease by approximately 12 dB, shown in step I2. In step I3 and I4, the installer locates the remote device and causes it to send an alarm signal message by opening the window, for example. If the alarm signal message was received by the receiver/control unit, then the console would beep and the installer would know there was adequate signal margin for that remote device. This is shown in step I5. If the siren did not sound, then the installer would relocate the remote device, in step I6 and cause an alarm signal message to be transmitted again. After the installer finds the proper placement of the first remote device, he continues with the rest of the remote devices to be located, shown in step I7. When all the remote devices are located, the installer returns the alarm system back to normal by keying in a normal mode command at the console, shown in step I8.

In accordance with the second mode of the invention, during normal operation of the system, a supervision mode is periodically generated. A supervision transmission sequence consists of a single pentad, which is a single group of five identical messages, as shown in section A of FIG. 4. Each message is approximately 20 ms in duration and is repeated every 100 ms as shown in FIG. 4. A normal, non-supervision alarm signal, which is transmitted typically only when a change in status of the alarm sensor occurs (e.g. when a door is opened), consists of a double pentad, which is two groups of five identical messages separated in time by approximately 1 second. This is shown in section B of FIG. 4.

Each identical message is 64 bits long and has a 16-bit preamble, 24 bits of transmitter serial number or keypad data, a single 8-bit status byte, and a 16-bit CRC (Cyclical Redundancy Character), as shown in section C of FIG. 4. The microprocessor 32 looks for a match to the preamble to detect an incoming signal. The status byte contains 8 data bits, shown as D1–D8 in section D of FIG. 2, which convey specific information. In this embodiment, D8=0 signifies that the received message was from a remote transmitter device which is capable of generating supervision transmissions, whereupon D1–D4 represent the state of up to 4 sensor inputs to that remote transmitter device, D5 indicates the state of that transmitter's battery, and D6=1 indicates that the received message was part of a supervision single pentad transmission. In this manner, the receiver circuitry is provided with coded information from the remote transmitter device unit which enables it to determine if the message is part of a supervision signal or part of a normal, non-supervision alarm signal. When the receiver detects that the present message is part of a supervision pentad, the sensitivity of the receiver is immediately reduced by switching both antennas to their on state. This causes the receiver/control unit 6 to receive signals at a power level of approximately 3 dB lower than its normal level.

Figure 5:
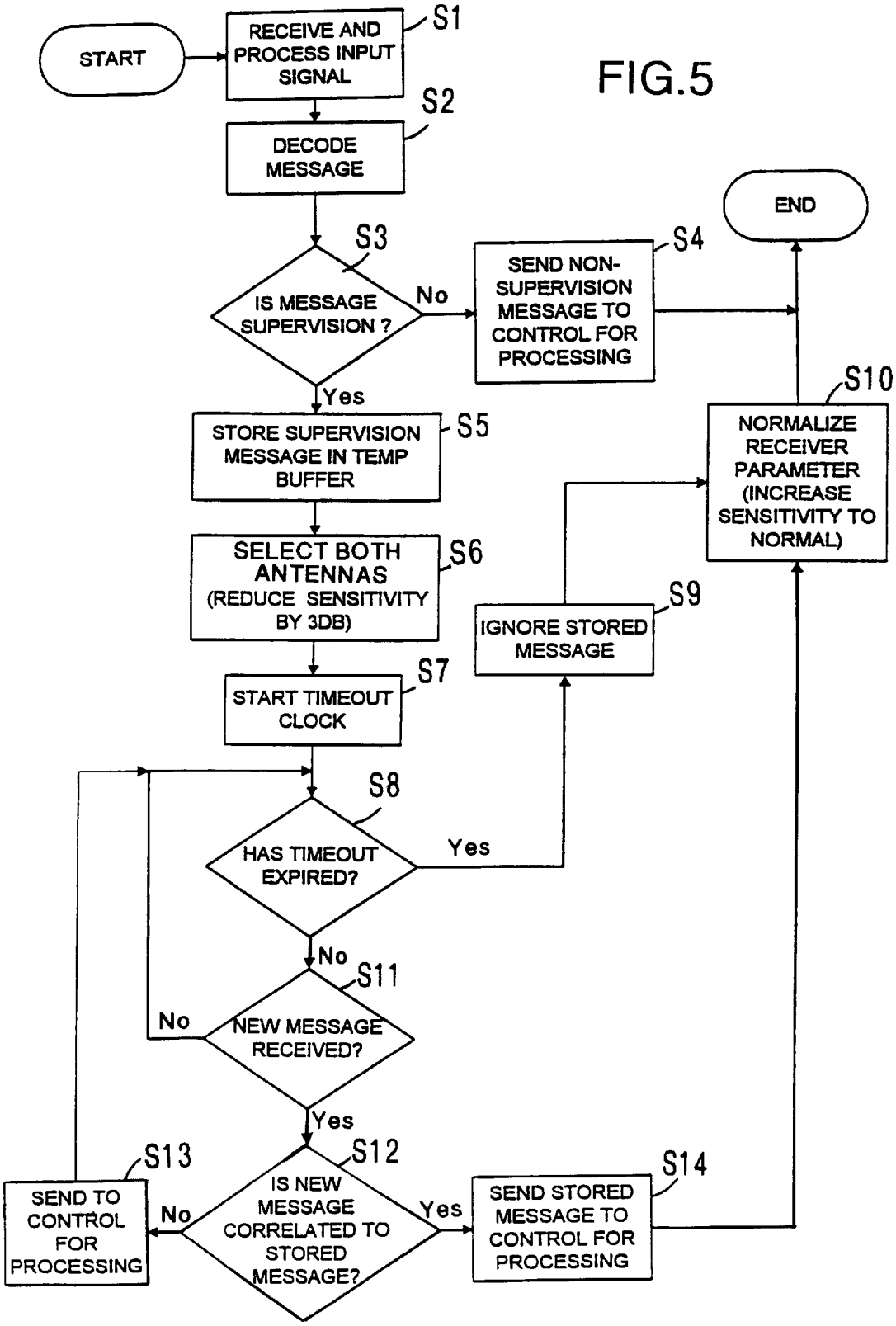
FIG. 5 is a flowchart of the operation of the preferred embodiment of the present invention for supervision mode.

The flow of operation for the periodic supervision mode of the present invention is illustrated by the flowchart set forth in FIG. 5. In step S1, the (RF) input signal is processed to provide a digital data signal. In step S2, the digital data signal is decoded to analyze the Data field for the status bit D6 to determine if the message is supervision. If step S3 determines the message to be non-supervision, then the message is sent to step S4 where the normal alarm processing takes place. If the message is determined to be a supervision message, then it is stored in a temporary buffer at step S5, and the processor outputs control signals to select both antennas, reducing receiver sensitivity by approximately 3 dB at step S6. A timeout clock, which in the preferred embodiment is 600 ms, is then initiated at step S7. The process loops in a wait state via steps S8 and S11 until the timeout expires at step S8 or a new message is received at step S11.

If the timeout has expired without a new message being received while the receiver is in the reduced sensitivity state, then the stored message is ignored at step S9, the receiver sensitivity is increased back to normal by selecting one of the antenna at step S10, and the process is ended. In this case, since the supervision message was not properly received and detected while the receiver was in the reduced sensitivity state, then the transmitter ID associated with that supervision message is, in effect, thrown out, and the receiver control unit is never informed of its initial reception at the full sensitivity level. Thus, although the supervision signal was strong enough to be detected at the normal sensitivity level, it could not be received at the effective reduction of approximately 3 dB in signal strength, and the UL864 test is not met for that remote device 4.

If however, a new message is received at step S11, then it is analyzed at step S12 to determine if it is the same as the message stored in the temporary buffer; that is, if it is from the same remote transmitter device or if it has been received from a different transmitting device which has in effect interleaved its message stream with that of the originally received message. If the message is from a different remote transmitter device, then it is sent to the control by step S13 (since it was successfully received at the reduced sensitivity level), and the wait state continues with steps S8 and S11. The timeout clock is not reset, since the receiver is still waiting for the next supervision message which matches that which initiated the reduction in sensitivity. Thus, if a new message matching the stored message is not received within the timeout period, the receiver sensitivity is increased to normal and the process ends with the stored message being ignored.

If, however, step S12 determines that the new message matches the stored message, then the test has passed and the message is sent to the control by step S14 for subsequent processing. The receiver sensitivity is increased back to normal and the process is exited.

In an alternative embodiment of the present invention for reducing the sensitivity of the receiver during the supervision time, a single antenna may be used whereby the current through the associated diode is controlled by a digital to analog converter. In this embodiment, even though a switching diode is not needed for antenna switching (since there is only one antenna), it is used in order to decrease the receiver sensitivity in accordance with the objectives set forth herein.

It will be apparent to those skilled in the art that modifications to the specific embodiments described herein may be made while still being within the spirit and scope of the present invention. For example, the transmitted messages may be formatted in many different ways, and that the invention is not dependent on a particular format. The flow of the programs described above may be performed in many different ways and that the invention is not dependent on a particular program flow.

In addition, an alarm system containing only one antenna may use the method described in the present invention for testing the signal margin of the alarm system during installation, and an alarm system containing more than two antennas may use the method described in the present invention for testing the signal margin of the alarm system during supervision.

We claim:

1. In an alarm system comprising a receiver/control unit having a receiver associated therewith and a plurality of remote transmitting devices relocatable with respect to the receiver/control unit, the receiver comprising at least one antenna device, a method for testing a signal margin of the alarm system during the installation of the alarm system comprising the steps of:

a) initiating an install mode in the receiver/control unit, b) impairing an operational parameter of the receiver by changing a characteristic of the antenna device, c) transmitting a message from a remote transmitting device, d) receiving the message at the receiver, and e) indicating when the message is successfully received.

2. The method of claim 1 wherein changing the characteristic of the antenna device comprises the step of switching the antenna device to a no antenna state.

3. The method of claim 1 further comprising the steps of:

f) when the message is not successfully received, then relocating the remote transmitter device, g) transmitting a message from the remote transmitter device, h) receiving, at the receiver, the message, and, i) indicating when the message is successfully received.

4. The method of claim 2 wherein the message is received at a power level that is approximately 12 dB lower than a normal operating power level as a result of changing a characteristic of the antenna device.

5. The method of claim 1 further comprising the step of subsequently initiating a normal operation mode in the receiver/control unit.

6. An alarm system comprising:

a) a receiver/control unit adapted to operate in an install mode, the receiver/control unit comprising at least one antenna device for receiving, during the install mode, a message at a reduced power level with respect to a normal operating power level, b) means for processing operatively associated with the receiver/control unit wherein the install mode causes the impairing of the ability of the receiver/control unit to receive a message by changing a characteristic of the antenna device, c) a plurality of remote devices, each of the remote devices comprising a remote transmitter device for transmitting a message, the remote transmitter device being relocatable with respect to the receiver/control unit, and d) means for indicating when the reduced power message is successfully received.

7. The system of claim 6 wherein the means for processing is adapted to change the characteristic of the antenna device by switching the antenna device to a no antenna state.

8. The system of claim 7 wherein the receiver/control unit receives at a power level that is approximately 12 dB lower than the normal operating power level as a result of changing a characteristic of the antenna device.

9. The system of claim 7 wherein the changing a characteristic of the antenna device is performed by switching diodes.

10. The system of claim 9 further comprising capacitors for control of the residual capacitance of the diodes in their off state, thereby controlling the conduction of the RF input signal.

11. The system of claim 9 further comprising a digital-to-analog converter for controlling the conduction of the RF input signal.

12. In an alarm system comprising a plurality of remote transmitting devices and a receiver/control unit having a receiver associated therewith, the receiver comprising at least one antenna device, each of the remote transmitting devices capable of transmitting a supervision signal having a plurality of correlated supervision messages, a method for testing a signal margin of an alarm system comprising the steps of:

a) receiving at the receiver/control unit a first message from a transmitting device, b) determining if the first message is a supervision message or a non-supervision message, and, c) impairing the ability of the receiver/control unit to receive a subsequent message by changing a characteristic of the antenna device when the first message is determined to be a supervision message.

13. The method of claim 12 wherein changing the characteristic of the antenna device is the selection of two or more antennas to an on state.

14. The method of claim 12 further comprising the steps of:

d) receiving a subsequent message, e) determining if the subsequent message is correlated to the first message, and, f) returning the changed characteristic of the antenna device to normal when the subsequent message is determined to be correlated to the first message.

15. The method of claim 12 further comprising the steps of returning the changed characteristic of the antenna device of the receiver to normal and ignoring the first message when, after a predetermined time, no subsequent message has been received which is correlated to the first message.

16. The method of claim 12 wherein at least one of the remote transmitting devices is associated with an alarm sensor, and wherein the non-supervision signal from the transmitting device associated with an alarm sensor is an alarm signal comprising alarm messages encoded with alarm sensor data.

17. The method of claim 13 wherein the message is received at a power level that is approximately 3 dB lower than the normal operating power level as a result of changing a characteristic of the antenna device.

18. An alarm system comprising:

(a) a plurality of remote devices, each of the remote devices having a transmitter for transmitting a supervision signal comprising a plurality of correlated supervision messages and an alarm signal comprising a plurality of correlated alarm messages indicative of an alarm status;

(b) a receiver/control unit comprising:

(i) a receiver for communications with each of the remote devices, the receiver comprising at least one antenna device, and, (ii) processing means operatively associated with the receiver for processing messages received from each of the remote devices, the processing means being configured to decode a first message received from a remote device and execute a supervision routine if the first message is determined to be a supervision message; wherein the supervision routine causes the impairing of the ability of the receiver/control unit to receive a subsequent message by changing a characteristic of the antenna device.

19. The alarm system of claim 18 wherein changing the characteristic of the antenna device is the selection of two or more antennas to an on state.

20. The alarm system of claim 18 wherein the supervision routine further causes the receiver to return to normal the changed characteristic of the antenna device and further process the first message when a subsequent message received from a remote device is correlated with the first message.

21. The alarm system of claim 18 wherein the supervision routine further causes the receiver to return to normal the changed characteristic of the antenna device and ignore the first message when, after the lapse of a predetermined time that the receiver has had its antenna device characteristics changed, no subsequent message has been received which is correlated with the first message.

* * * * *